US012326310B2

(12) United States Patent
Berg

(10) Patent No.: US 12,326,310 B2
(45) Date of Patent: Jun. 10, 2025

(54) FIREARM NOISE SUPPRESSOR

(71) Applicant: Daren Berg, Edgemont, SD (US)

(72) Inventor: Daren Berg, Edgemont, SD (US)

(73) Assignee: Daren Berg, Edgemont, SD (US)

( * ) Notice: Subject to any disclaimer, the term of this patent is extended or adjusted under 35 U.S.C. 154(b) by 292 days.

(21) Appl. No.: 17/833,641

(22) Filed: Jun. 6, 2022

(65) Prior Publication Data

US 2023/0003479 A1 Jan. 5, 2023

Related U.S. Application Data

(60) Provisional application No. 63/197,314, filed on Jun. 4, 2021.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34; F41A 21/32; F41A 21/28; F01N 1/084; F01N 1/082; F01N 2470/24
See application file for complete search history.

(56) References Cited

U.S. PATENT DOCUMENTS 851,490 A * 4/1907 Brisben ..... F01N 1/14 181/263
1,487,312 A * 3/1924 Bull ..... F41A 21/34 123/198 R
1,605,864 A * 11/1926 Steinegger ..... F41A 21/30 89/14.3
2,451,514 A * 10/1948 Sieg ..... F41A 21/30 89/14.3
2,503,491 A * 4/1950 Janz ..... F41A 21/30 89/14.4
2,883,781 A * 4/1959 Harvey ..... F41A 21/38 42/105
2,916,970 A * 12/1959 Mutter ..... F41A 21/28 89/14.3

(Continued)

FOREIGN PATENT DOCUMENTS

CN 110425929 A 11/2019
EP 1400662 A1 * 3/2004 ..... F01N 1/02

(Continued)

OTHER PUBLICATIONS

International Search Report and Written Opinion dated Mar. 8, 2023 issued by the International Searching Authority in related International PCT Patent Application No. PCT/US2022/032289; filed Jun. 6, 2022.

*Primary Examiner* — Edgardo San Martin
(74) *Attorney, Agent, or Firm* — Gordon Rees Scully & Mansukhani, LLP

(57) ABSTRACT

A suppressor system for a firearm having aligned sleeve openings between the barrel or a central tube and an inner sleeve. The suppressor system further includes dividers located between an outer sleeve and the inner sleeve. The (Continued)

suppressor system provides improved noise attenuation through the expansion of hot gasses multiple cavities in the suppressor system and also by slowing the hot gasses via tortuous pathways or collision of hot gasses in the suppressor system.

20 Claims, 10 Drawing Sheets

(56) References Cited

U.S. PATENT DOCUMENTS

| | | | | | |
|---|---|---|---|---|---|
| 5,136,923 | A * | 8/1992 | Walsh, Jr. | F41A 21/30 | 89/14.4 |
| 5,367,940 | A * | 11/1994 | Taylor | F41A 21/36 | 89/14.3 |
| 5,463,930 | A * | 11/1995 | Bisping | F41A 21/32 | 89/14.3 |
| 5,798,473 | A * | 8/1998 | Roblyer | F41A 21/28 | 89/14.3 |
| 5,814,757 | A * | 9/1998 | Buss | F41A 21/36 | 89/14.3 |
| 6,880,444 | B2 * | 4/2005 | Ang | F41A 21/30 | 89/14.3 |
| 7,587,969 | B2 | 9/2009 | Silvers | | |
| 8,091,263 | B1 * | 1/2012 | Palmer | F41A 21/40 | 42/1.06 |
| 8,464,625 | B2 * | 6/2013 | Polovnev | F41A 21/28 | 89/14.2 |
| 10,077,962 | B1 | 9/2018 | Dean | | |
| 10,352,210 | B2 * | 7/2019 | Hanschen | F01N 1/006 | |
| 10,533,819 | B2 | 1/2020 | Thomas | | |
| 10,684,088 | B2 | 6/2020 | Lo | | |
| 10,907,517 | B2 * | 2/2021 | Qi | F01N 1/026 | |
| 11,162,754 | B2 | 11/2021 | Heckenlively | | |
| 11,268,777 | B1 * | 3/2022 | Grant | F41A 21/34 | |
| 2012/0291614 | A1 | 11/2012 | Koumbis | | |
| 2016/0123689 | A1 | 5/2016 | Maeda | | |
| 2018/0313625 | A1 | 11/2018 | Tomczak | | |
| 2018/0347932 | A1 | 12/2018 | Bray | | |
| 2019/0242667 | A1 | 8/2019 | Lo | | |

FOREIGN PATENT DOCUMENTS

| | | | | |
|---|---|---|---|---|
| EP | 1507071 | A1 * | 2/2005 | F01N 1/003 |
| FR | 2677743 | A1 * | 12/1992 | F41A 21/30 |

* cited by examiner

FIREARM NOISE SUPPRESSOR

CROSS-REFERENCE TO RELATED APPLICATION

The present application claims priority to and the benefit of U.S. Provisional Patent Application No. 63/197,314 filed on Jun. 4, 2021. The foregoing provisional application is incorporated by reference herein in its entirety.

GENERAL DESCRIPTION

The present disclosure relates to firearm noise suppressor. In particular, a noise suppressor preferably for a shotgun.

Suppressors are muzzle devices that dampen the acoustic emission and reduce muzzle flash created by the fire arm by modulating the speed and pressure of the gases exiting the firearm. Suppressors or silencers may be typically mounted as a detachable accessory mounted on to the muzzle of the fire arm or an integral part of the firearm barrel. Typically, suppressors are utilized in rifles and pistols. There is a demand for improvements of silencers for different types of firearms, specifically shotguns.

As described herein, an improved silencer or suppressor for a shotgun is provided.

BRIEF DESCRIPTION OF THE DRAWINGS

The features, aspects, and advantages of the disclosed deliver system will become apparent from the following description, and the accompanying exemplary embodiments shown in the drawings, which are briefly described below.

DETAILED DESCRIPTION

An exemplary embodiment of a suppressor system for a firearm is disclosed herein. The suppressor system includes an inner sleeve surrounding a barrel of the firearm, an outer sleeve surrounding the barrel and the inner sleeve, a plurality of barrel openings circumferentially disposed around a muzzle end of the barrel, wherein the inner and outer sleeve surrounds the plurality of barrel openings, and a plurality of inner sleeve openings circumferentially disposed around the inner sleeve, wherein each inner sleeve opening of the plurality of inner sleeve openings are aligned with each barrel opening of the plurality of barrel openings.

According to another exemplary embodiment, a suppressor assembly is attached to a firearm. The firearm includes a barrel and the suppressor assembly includes a central tube, having a central tube fastening interface. An inner sleeve surrounds the central tube, the inner sleeve includes an inner sleeve fastening interface configured to fasten to the barrel. An outer sleeve surrounds the central tube and the inner sleeve. The outer sleeve includes an outer sleeve fastening interface, a plurality of central tube openings circumferentially disposed around the central tube. The outer sleeve fastening interface is configured to attach to the inner sleeve fastening interface and the central tube fastening interface.

According to another disclosed embodiment, a firearm including a barrel is disclosed. The barrel includes a plurality of barrel openings circumferentially disposed around a muzzle end of the barrel. An inner sleeve surrounds a barrel of the firearm. The inner sleeve includes a plurality of inner sleeve openings circumferentially disposed around the inner sleeve. An outer sleeve surrounds the barrel and the inner sleeve, wherein the inner and outer sleeve surrounds the plurality of barrel openings; and wherein the outer sleeve is configured to fasten onto the inner sleeve and the barrel via an outer sleeve fastening mechanism located between the inner sleeve and the barrel.

Figure 1:
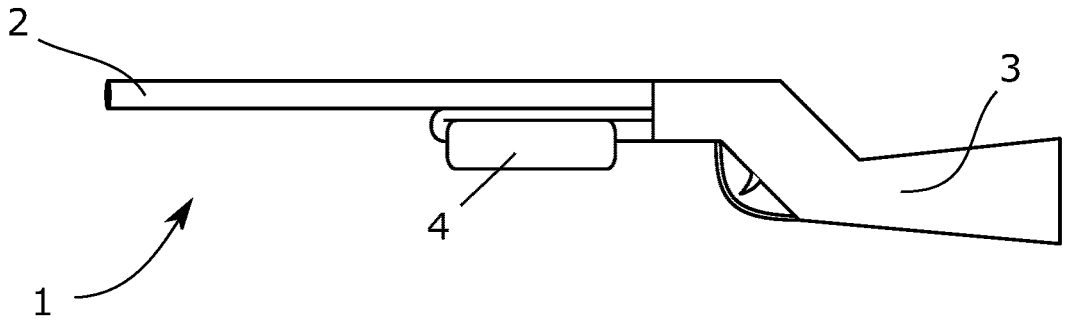
FIG. 1 PRIOR ART
FIG. 1 is a current prior art fire arm.

FIG. 1 illustrates a prior art shotgun 1 having, a barrel 2, stock 3, and forestock or forearm 4.

Figure 2:
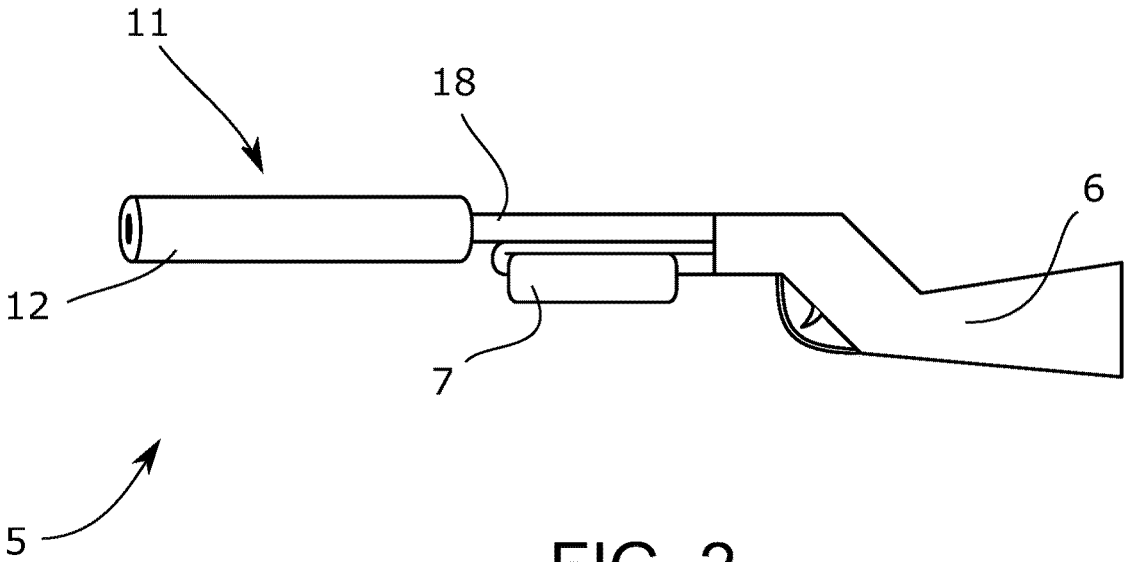
FIG. 2 is an exemplary firearm with an exemplary suppressor system.

FIG. 2 illustrates a shotgun 5 including an exemplary embodiment of the suppressor system 11. The shotgun including a barrel 18, stock 6, and forestock or forearm 7. The suppressor system includes a suppressor 12 that is attached around the barrel 18 of the shotgun 5.

Figure 3:
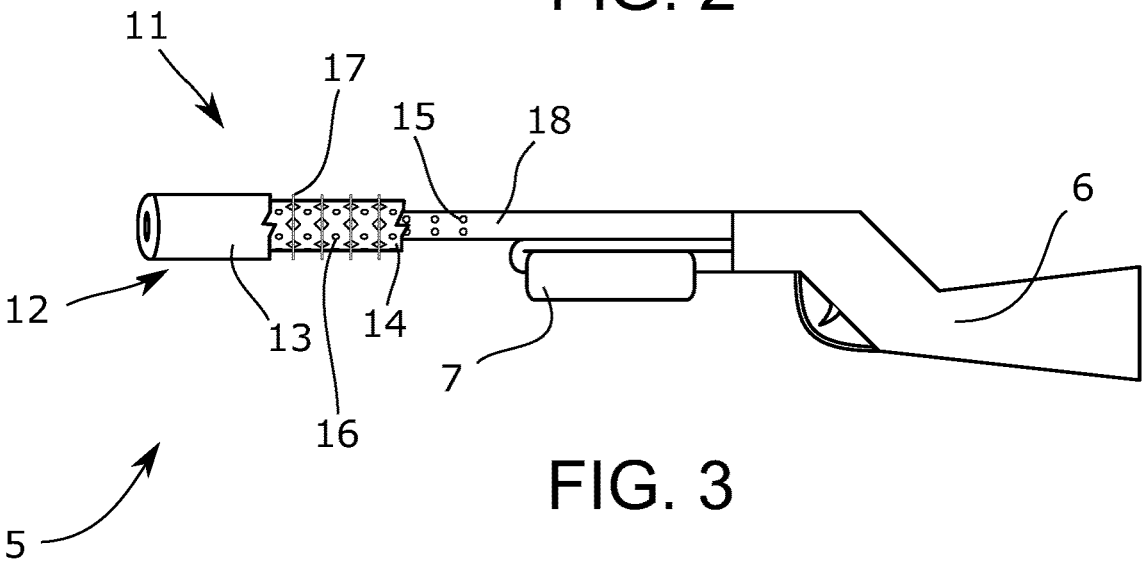
FIG. 3 is the exemplary firearm shown in FIG. 2 with a cut view.

FIG. 3 illustrates the shotgun 5 with the suppressor system 11 as shown in FIG. 2 with a section cutaway to show the internals of the suppressor system 11. The suppressor 12 of the suppressor system 11 includes an outer sleeve 13 and an inner sleeve 14. The suppressor system also includes barrel openings 15. The barrel openings 15 may be manufactured as part of the shotgun or formed post-production as part of the making of the suppressor system 11. Inner sleeve 14 includes inner sleeve openings 16. Dividers, (e.g., rings or baffles) 17 are located between the inner sleeve 14 and the outer 13. The dividers 17 provide spacing and create discrete cavities between the inner sleeve 14 and outer sleeve 13. The dividers 17 may be annularly disposed around the inner sleeve 14.

Figure 4:
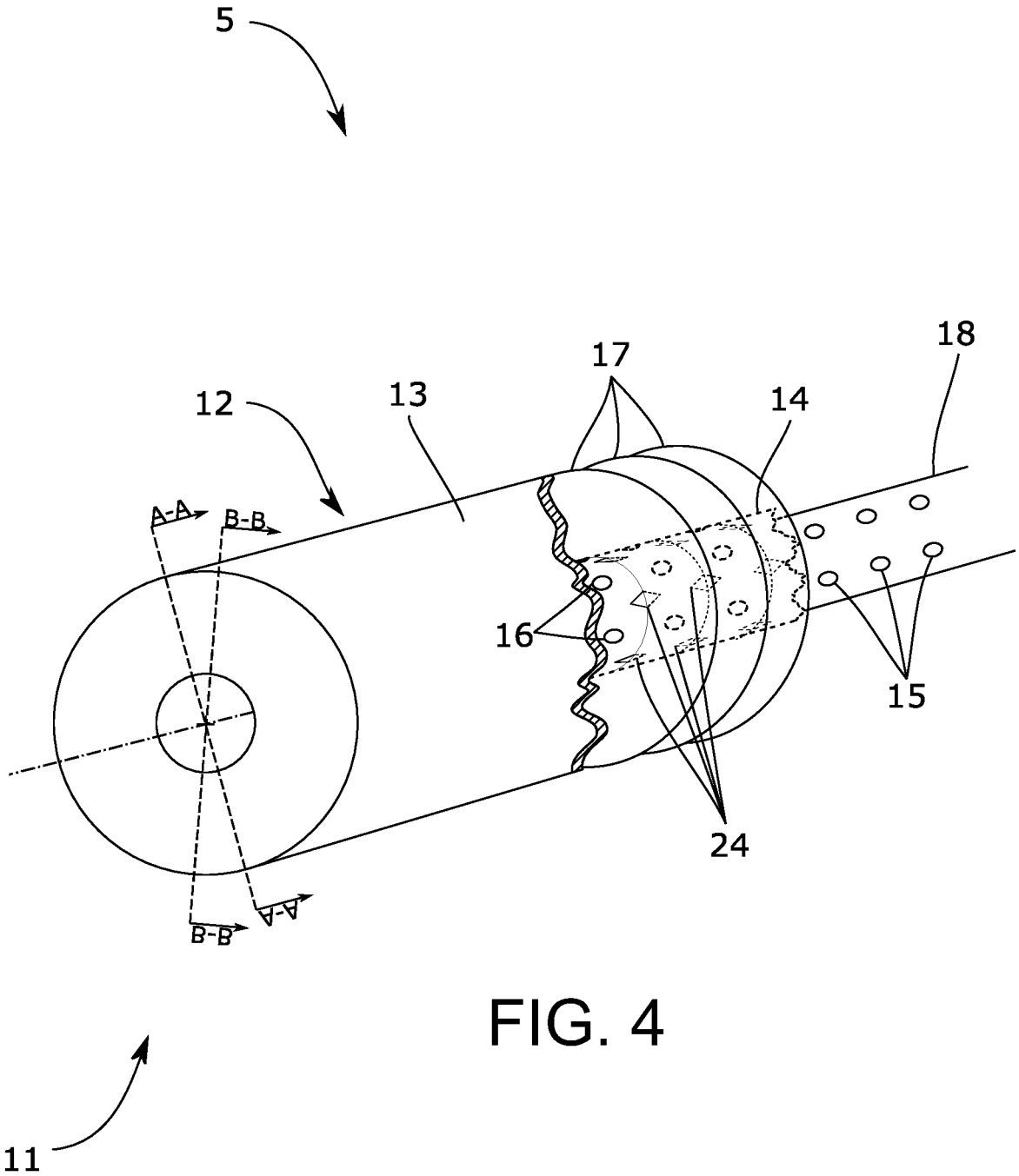
FIG. 4 is a close-up isometric view of the exemplary firearm shown in FIG. 3.
Figure 5:
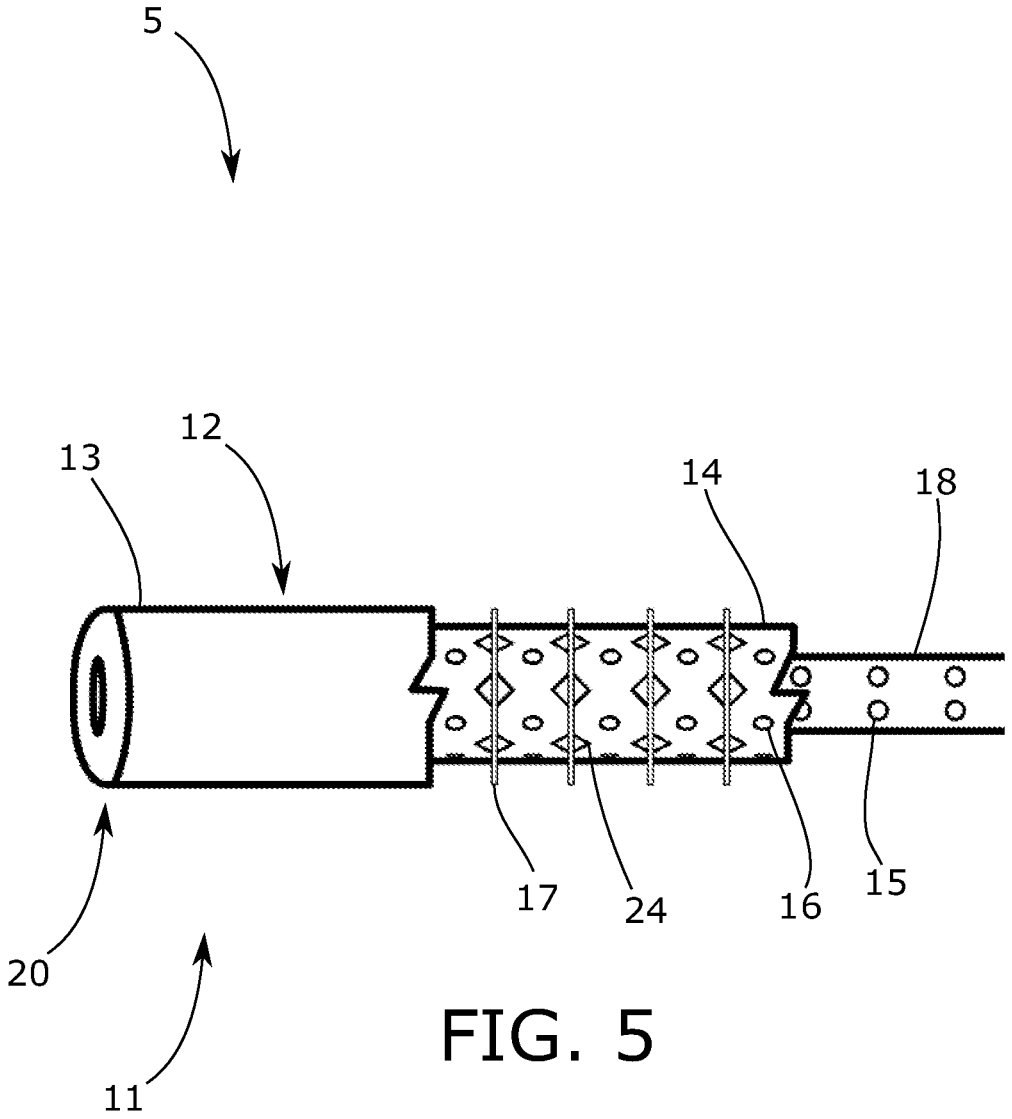
FIG. 5 is a close up side view of the exemplary firearm shown in FIG. 3.

FIGS. 4 and 5 illustrate a close up of the shotgun 5 with a portion of the suppressor 12 removed. The barrel openings 15 and inner sleeve openings 16 line up (i.e., are positioned coaxially) to each other. This configuration allows improved noise attenuation by allowing the gaseous propellant discharged by the shotgun shells to expand in two different portions of the suppressor 12 through the different openings 15/16.

Figure 6:
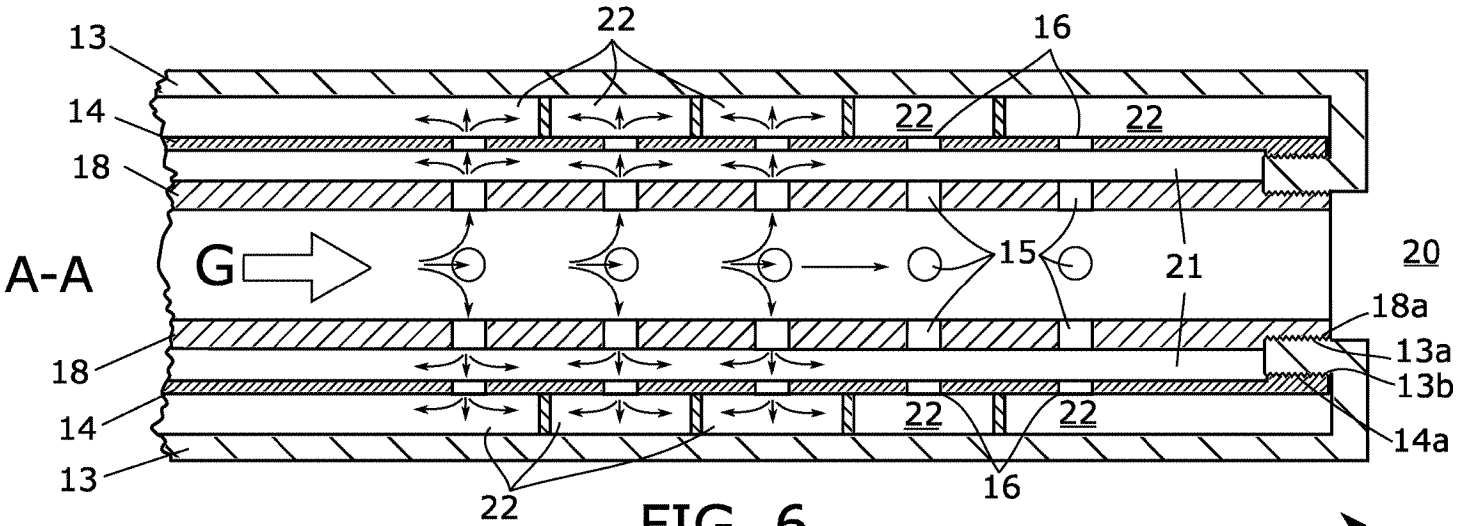
FIG. 6 is a view of the section cut along line A-A shown in FIG. 4.
Figure 7:
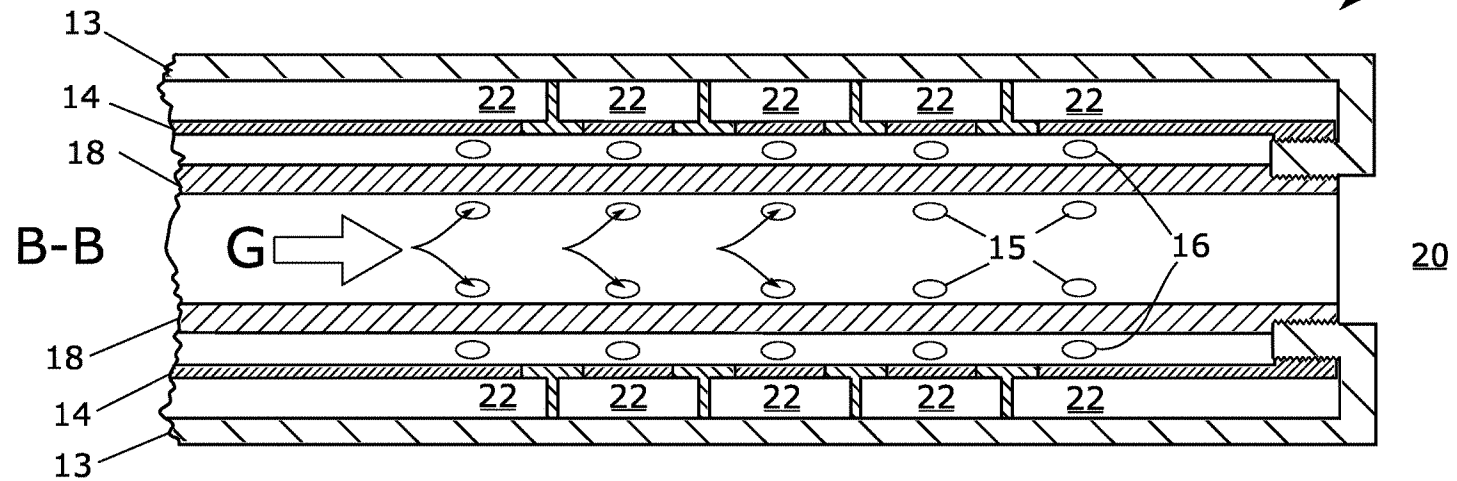
FIG. 7 is a view of the section cut along line B-B shown in FIG. 4.

FIGS. 6 and 7 show sectional views of the suppressor system 11 along the lines A-A and B-B respectively. After the firing or striking of the shotgun shell (not shown) within the barrel 18, the gaseous propellant 'G' will travel along the barrel toward the muzzle end 20 of the barrel. The smaller arrows shown show the flowpath of the gaseous propellant G after a period of time Δt after firing of the shotgun shell. The barrel openings 15 allow the gaseous propellant to travel and expand within the inner sleeve cavity 21 of the inner sleeve 14. The inner sleeve openings 16 allow further expansion of the gases into the plurality of outer sleeve cavities 22. The inner sleeve cavity 21 is not partitioned into a plurality of cavities like the cavities 22 found within the outer sleeve. The expansion of gases within the inner sleeve cavity 21 allows for interference areas 23. The interference areas 23 are areas in which the gases interact and interfere with each other in order to slow down the gas velocity as a result of the collision of moving gases particles and/or molecules.

The barrel 18, the inner sleeve 14, and the outer sleeve 13 are fastened to each other at the muzzle end 20 through threaded interfaces 18*a*, 14*a*, 13*a*, and 13*b*. The threaded interface 18*a* of the barrel fastens to threaded interface 13*a*, and threaded interface 14*a* of the inner sleeve fastens to the threaded interface 13*b*, thus interlocking the barrel 18, inner sleeve 14, and outer sleeve 13 together. This interlocking configuration allows the suppressor system 11 to be utilized without any adapters or further extensions such as chokes that need to be attached to the end of the barrel 18.

The inner sleeve 14 also includes divider apertures 24 configured to hold the dividers 17 axially and circumferentially so that the dividers cannot move along the sleeves 13/14 and do not rotate relative to the sleeves 13/14. The dividers 17 also aid in the directing of gases with the portion placed within the divider apertures 24, which may be diamond shaped, rectangular, square, circular, oval, or any other shape capable of holding the dividers. Similarly, the shapes of the inner sleeve openings 16 can be circular, or any other shape that can be easily fabricated or manufactured onto the barrel. The thickness of the inner sleeve 14 and outer sleeve 13 may depend on the required noise attenuation and heat dissipation needed by the firearm. The dividers 17 may also be angled forward (i.e., the most radially outward portion leaning towards the muzzle or the exit of the firearm suppressor/barrel).

The divider apertures 24, inner sleeve openings 16, and barrel openings 15 are circumferentially disposed in a generally uniform pattern around the corresponding cylindrical structure (i.e., the inner sleeve and the barrel). Along the length of the inner sleeve 14, the divider apertures 24 and the openings 16 are disposed in an alternating pattern. The spacing and pattern of the different apertures and/or openings can be varied depending on the dimensions of the barrel or the inner sleeve.

The inner sleeve cavity 21 circumferentially surrounds the barrel 18 and is unpartitioned. The inner sleeve cavity 21 is in fluid communication with the barrel 18 via barrel openings 15. The outer sleeve cavities 22 are discrete cavities that circumferentially surrounds the inner sleeve 14 and are partitioned by dividers 17. Each outer sleeve cavity 22 only extends axially between each divider 17 and are in fluid communication with the inner sleeve cavity 21 at different axial locations along the inner sleeve cavity via inner sleeve openings 16. The number of dividers and the openings 15/16 can also be modified depending on the firearm length, the required noise attenuation, and projectile characteristics. The embodiment described above allows for a shorter overall length. The shorter length will allow easier use especially in confined areas such as in transport vehicles (cars, trucks, SUV's, helicopters, etc.) and in buildings (hall ways, doors, stair cases, elevators, etc.). The shorter length also allows quicker target acquisition especially in confined areas such as clearing rooms in a building.

Figure 8:
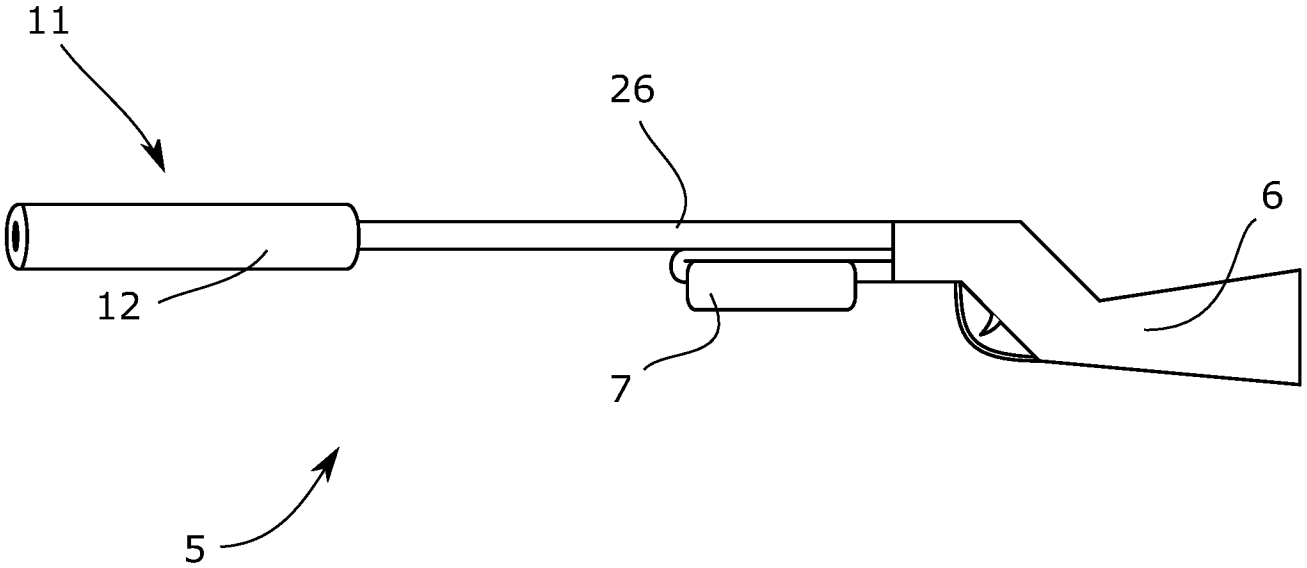
FIG. 8 is an exemplary firearm with another exemplary suppressor system.
Figure 9:
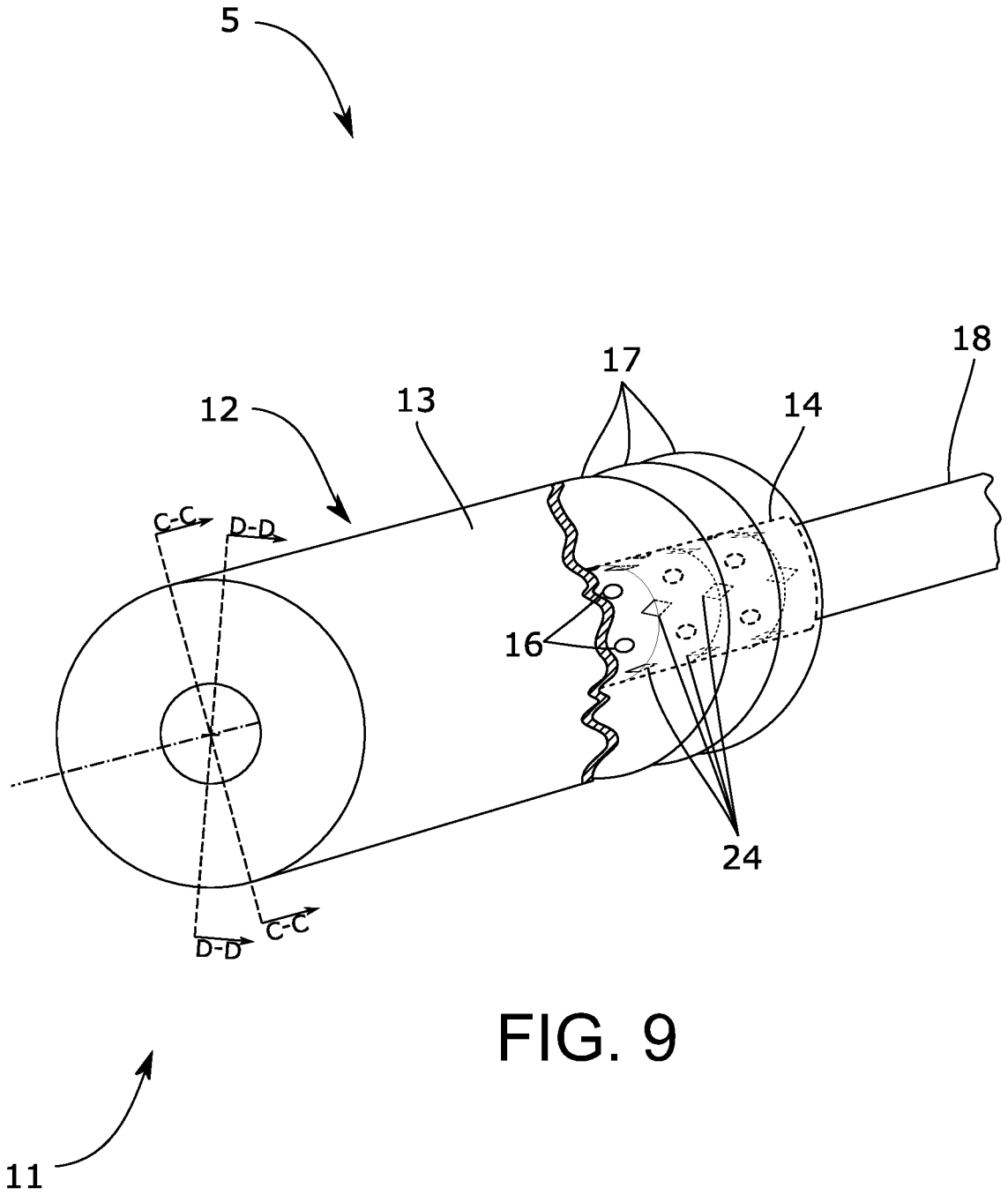
FIG. 9 is a close-up isometric view of the exemplary firearm shown in FIG. 8.

FIG. 8 shows another embodiment in which the suppressor system 11 is configured as an extension of the barrel 26. FIG. 9 shows an isometric view of this configuration.

Figure 10A:
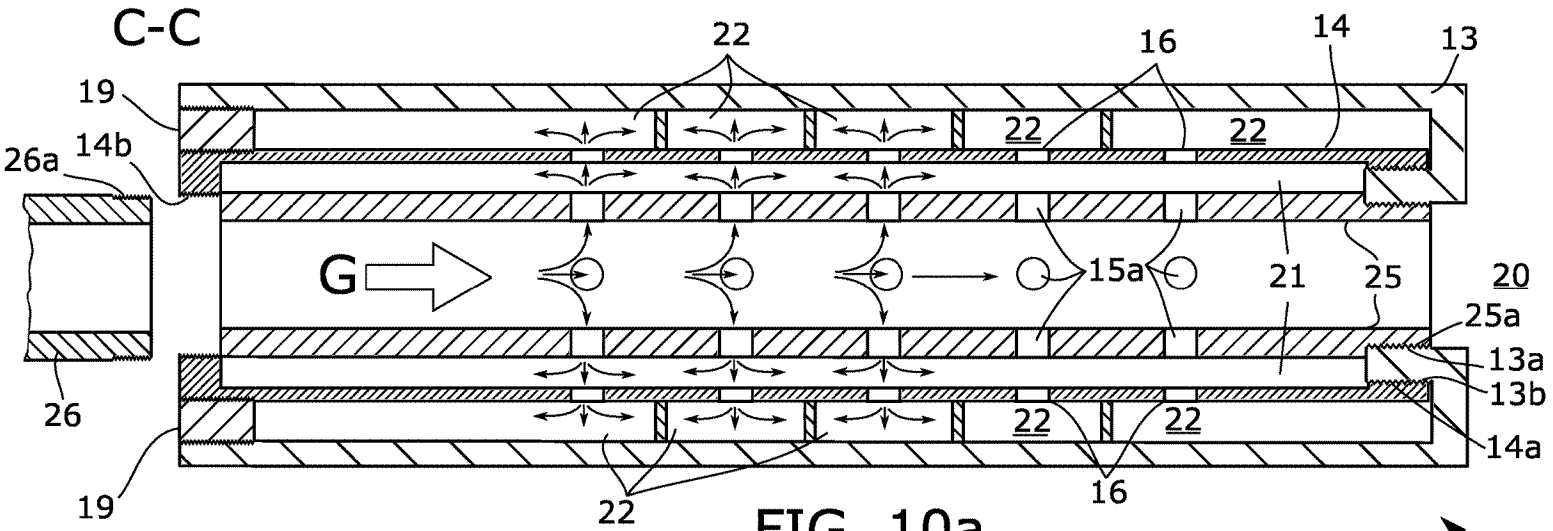
FIG. 10*a* is a view of the section cut along line C-C shown in FIG. 9.
Figure 10B:
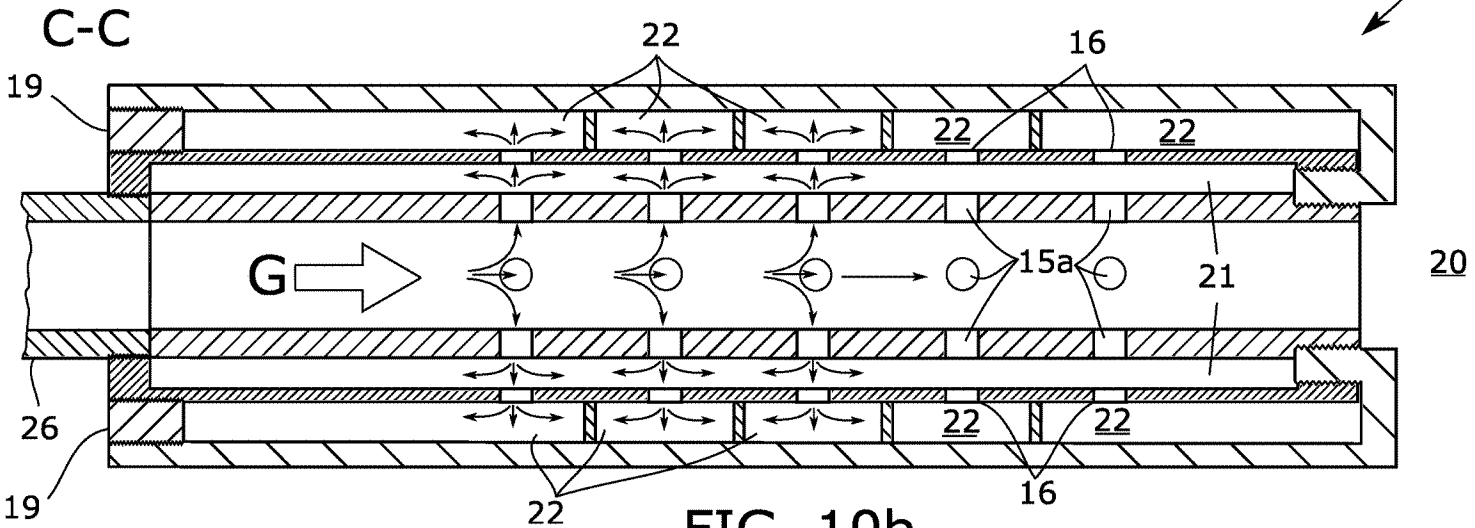
FIG. 10*b* is a view of the section cut along line C-C shown in FIG. 9 in an assembled state.
Figure 11:
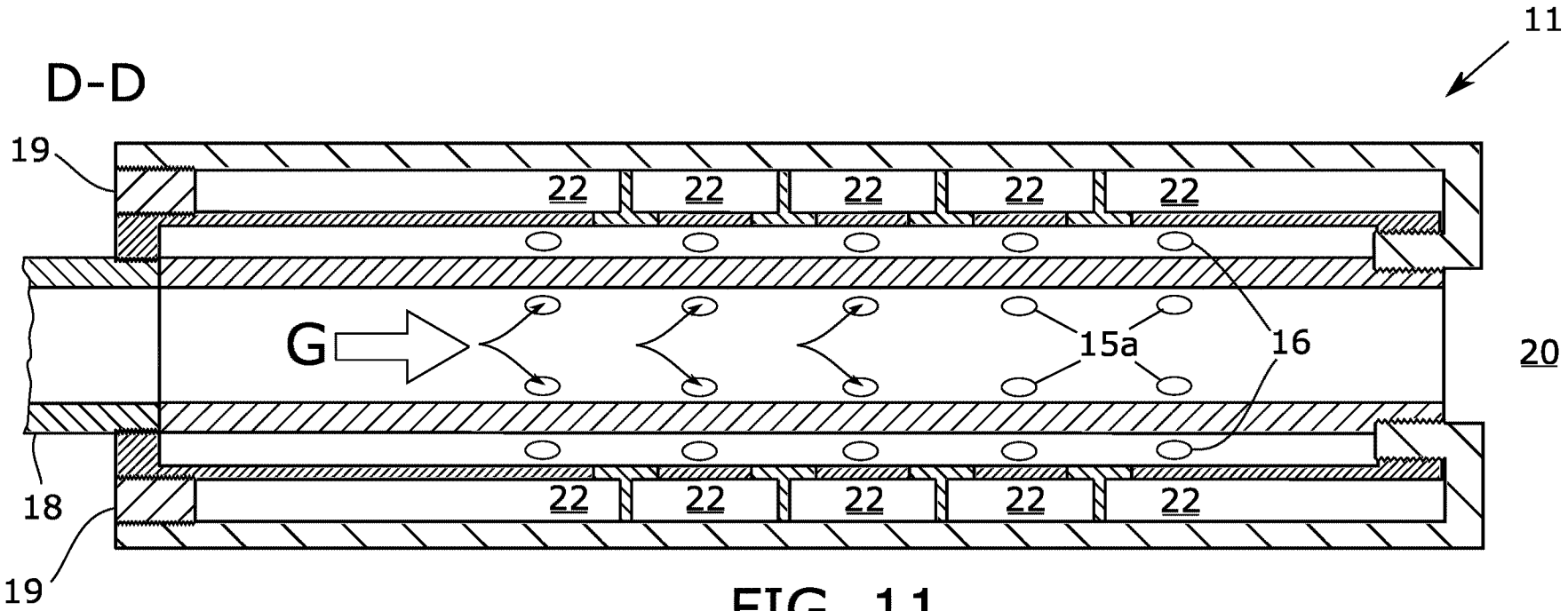
FIG. 11 is a view of the section cut along line D-D shown in FIG. 9 in an assembled state.

FIGS. 10*a* and 10*b* shows the section C-C as labeled in FIG. 9. In this embodiment, instead of surrounding the barrel 26, the suppressor system 11 now includes a central tube 25 which now contains the openings 15*a* and threaded interface 25*a*. The system operates similarly to the embodiment described above in FIGS. 2-7. The barrel 26 is attached to the inner sleeve 14 through the fastening interface 25*a* and 14*b*. An end cap 19 is located at the end of the suppressor system 11 to close the outer sleeve cavity 22. In this embodiment, the inner sleeve cavity 21 is now defined by the inner sleeve 14 and the central tube 25. FIG. 10*a* shows the suppressor system 11 detached from the firearm barrel 26 and FIG. 10*b* shows the assembled view of the suppressor system 11. FIG. 11 shows the section D-D in FIG. 9.

Figure 12A:
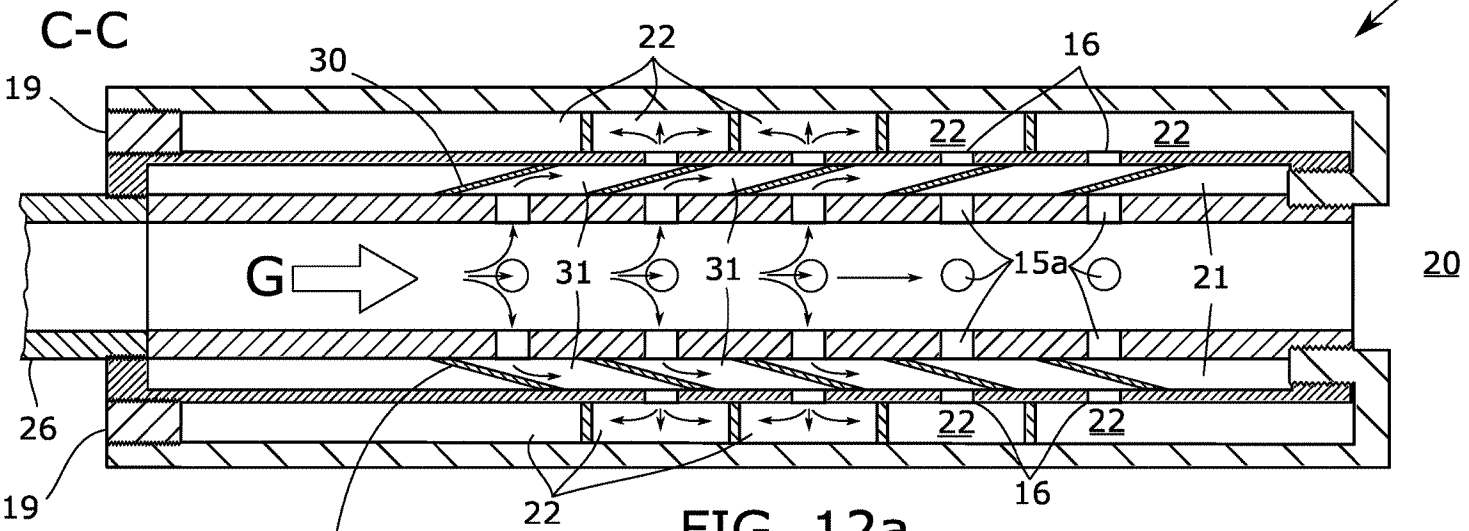
FIG. 12*a* is a sectional view of an alternative embodiment.
Figure 12B:
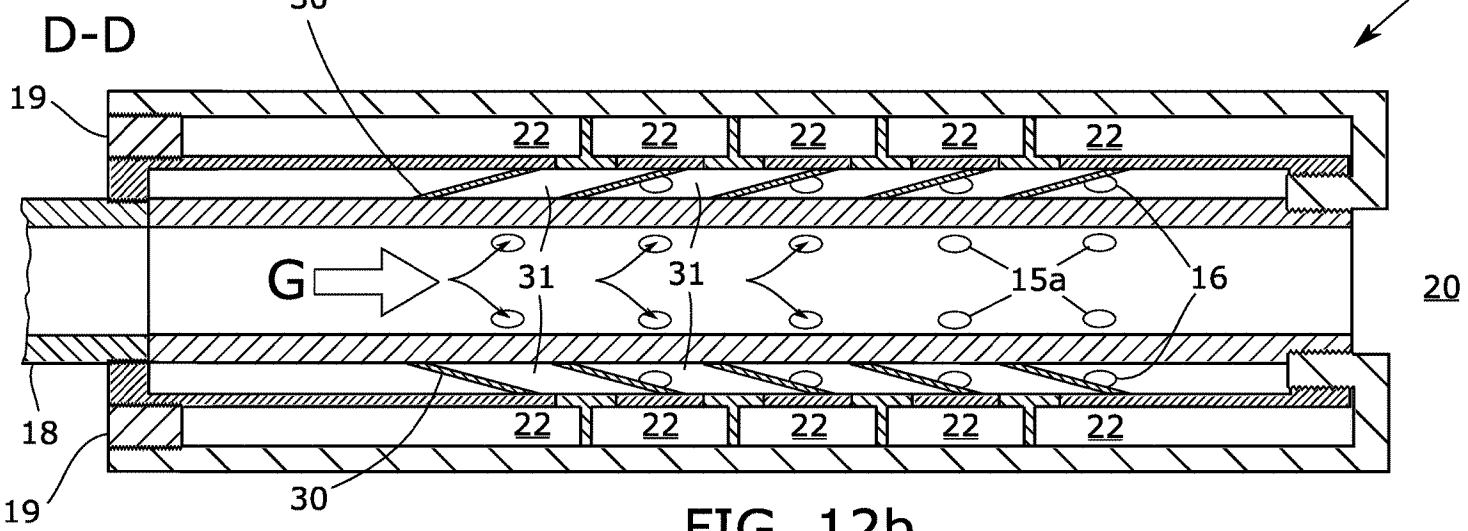
FIG. 12*b* is a sectional view of an alternative embodiment.

FIGS. 12*a* and 12*b* is an alternative embodiment of the screw on suppressor of FIGS. 10*b*, and 11 with baffles 30 within the inners sleeve 14. Baffles 30 further divide the inner sleeve to discrete circumferentially extending cavities 31. The baffles created tortuous pathways for the hot gasses to travel through in order to slow the gasses down and attenuate sound.

Figure 13:
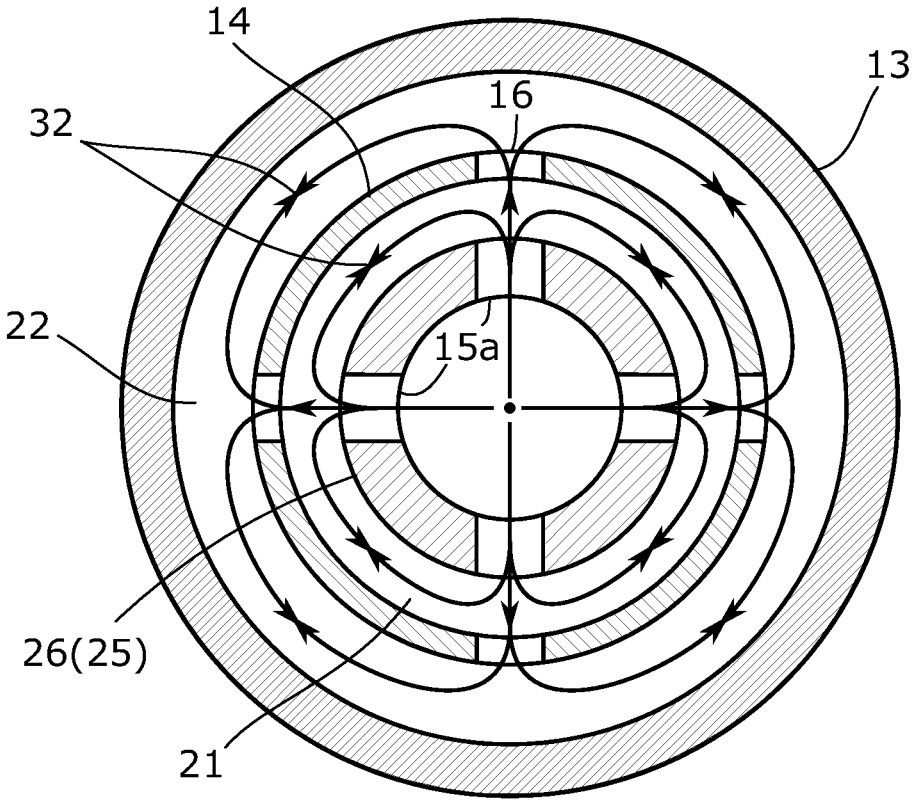
FIG. 13 is a cross-section view of a suppressor according to an exemplary embodiment.

FIG. 13 shows a cross-section of an embodiment of a suppressor. This perspective view shows an exemplary interference point 32 of hot gasses at cavities 22 and 21. The hot gas streams generated by the projectile propellant interact and interfere so that one or more gas stream interacts with another gas stream or streams at interference points 32. This interaction and interference of the gas streams results in an attenuation of the noise resulting from the firing of the projectile.

The embodiment shown in FIG. 13 may be incorporated into the basic structure of the suppressor described above. As shown in FIG. 13, the annular cavity is configured so that the gases resulting from the firing of the bullet travel circumferentially in the annular cavity in a manner that results in multiple separate streams of gases and wherein at least two of the streams are traveling in opposite directions and collide thereby resulting in an attenuation of noise resulting from the firing of the bullet.

Materials utilized by the suppressor system may include titanium or titanium alloy. Titanium has a higher strength than steel and aluminum while also having a melting point higher than steel and a much higher melting point than aluminum.

In sum, an improved suppressor system is provided above with improved noise attenuation and heat dissipation. The inner sleeve cavity and outer sleeve cavities act as expansion chambers, which allows for better acoustic attenuation and acoustic absorption. Rather than relying on the cones to reduce the noise and gas pressure, the expansion chamber has a number of apertures allowing the gas pressure and sound to enter. The gases follow the tortuous path and fill the expansion chambers. The dividers further control the direction of the gas pressure. Portions of the dividers in the divider apertures also direct the gas and control the gas pressure waves and sound waves to collide a controlled manner using interference from collision of gases to attenuate sound. The configuration above also allows for easy assembly/disassembly. The addition of cavities provides expansion chambers to the suppressor system to significantly reduce the back pressure of gas in the barrel, which can be a major problem in conventional firearms. Conventional suppressors may increase back pressure and thus require substantial changes to the suppressing system. The same is true for any integrated suppressors on the barrel of the firearm. The described system herein avoids these problems.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the suppressor system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed:

1. A suppressor system for attenuating sound of hot gases from a bullet in a firearm, the suppressor system comprising:

an inner sleeve surrounding a barrel of the firearm;

an outer sleeve surrounding the barrel and the inner sleeve;

a plurality of barrel openings circumferentially disposed adjacent a muzzle end of the barrel;

wherein the inner and outer sleeve surrounds the plurality of barrel openings; and a plurality of inner sleeve openings circumferentially disposed around the inner sleeve, wherein each inner sleeve opening of the plurality of inner sleeve openings are aligned with each barrel opening of the plurality of barrel openings; and wherein, within a plane perpendicular to a longitudinal axis of the barrel of the firearm, each barrel opening is spaced 90° from adjacent most barrel openings within the plane, and each inner sleeve opening is spaced 90° from adjacent most sleeve openings within the plane.

2. The suppressor system of claim 1, further comprising a plurality of annular dividers positioned between the outer sleeve and inner sleeve.

3. The suppressor system of claim 2, wherein each annular divider is spaced axially, relative to a longitudinal axis of the barrel, between each circumferential set of inner sleeve openings, such that the inner sleeve openings and the annual dividers create an alternating pattern along the longitudinal axis of the barrel.

4. The suppressor system of claim 3, wherein an annular cavity defined by the outer sleeve, the inner sleeve, and at least one divider of the plurality of dividers is in fluid communication with the barrel.

5. The suppressor system of claim 4, wherein the annular cavity is configured so that the gases resulting from the firing of the bullet travel circumferentially in the annular cavity in a manner that results in multiple separate streams of gases and wherein at least two of the streams are traveling in opposite directions and collide thereby resulting in an attenuation of noise resulting from the firing of the bullet.

6. The suppressor system of claim 1, wherein the outer sleeve is configured to fasten onto the inner sleeve and the barrel via an outer sleeve fastening mechanism located between the inner sleeve and the barrel.

7. A suppressor assembly attached to a firearm, the firearm including a barrel, the suppressor assembly comprising:

a central tube, having a central tube fastening threads;

an inner sleeve surrounding the central tube, the inner sleeve including first inner sleeve fastening threads configured to fasten to the barrel;

an outer sleeve surrounding the central tube and the inner sleeve, the outer sleeve including an outer sleeve fastening threads;

a plurality of central tube openings circumferentially disposed around the central tube; and wherein the outer sleeve fastening threads is configured to attach to the inner sleeve fastening threads and the central tube fastening threads;

wherein the outer sleeve includes a bent portion extending radially inward and rearward relative to a longitudinal axis of the barrel;

wherein the bent portion includes the fastening threads at the muzzle end of the central tube, wherein the fastening threads is located at the rearward bend of the bent portion, where the rearward bend is threaded to and sandwiched between the fastening threads of the central tube and a second inner sleeve fastening threads of the inner sleeve.

8. The suppressor assembly of claim 7, wherein the inner sleeve includes a plurality inner sleeve openings circumferentially disposed around the inner sleeve.

9. The suppressor assembly of claim 8, wherein the plurality inner sleeve openings is aligned with the plurality of central tube openings.

10. The suppressor assembly of claim 9, wherein, within a plane perpendicular to the barrel of the firearm, each barrel opening is spaced 90° from adjacent most barrel openings within the plane, and each inner sleeve opening is spaced 90° from adjacent most sleeve openings within the plane.

11. The suppressor assembly of claim 10, wherein the plurality of central tube openings and the plurality of inner sleeve openings are disposed axially along the length of the central sleeve tube and inner sleeve openings respectively.

12. The suppressor assembly of claim 7, further comprising a plurality of annular baffles located between the inner sleeve and the central tube.

13. The suppressor assembly of claim 10, further comprising a plurality of annular baffles located between the inner sleeve and the central tube such that the aligned inner sleeve openings are separated with the corresponding aligned central tube openings.

14. The suppressor assembly of claim 7, further comprising and end cap located at the muzzle end of the barrel between the outer sleeve and the inner sleeve.

15. A firearm comprising:

a barrel, wherein the barrel includes a plurality of barrel openings circumferentially disposed adjacent a muzzle end of the barrel;

an inner sleeve surrounding a barrel of the firearm, the inner sleeve including a plurality of inner sleeve openings circumferentially disposed around the inner sleeve;

an outer sleeve surrounding the barrel and the inner sleeve;

wherein the inner and outer sleeve surrounds the plurality of barrel openings; and wherein the outer sleeve includes a bent portion extending radially inward and rearward relative to a longitudinal axis of the barrel; and wherein the bent portion includes fastening threads at the muzzle end of the barrel, wherein the fastening threads is located at the rearward bend of the bent portion, where the rearward bend is threaded to and sandwiched between fastening threads of the barrel and fastening threads of the inner sleeve at the muzzle end of the barrel.

16. The firearm of claim 14, further comprising a plurality of annular dividers positioned between the outer sleeve and inner sleeve.

17. The firearm of claim 15, wherein each annular divider is spaced axially, relative to the longitudinal axis of the barrel, between each circumferential set of inner sleeve openings, such that the inner sleeve openings and the annual dividers create an alternating pattern along the longitudinal axis of the barrel.

18. The firearm of claim 16, wherein an annular cavity defined by the outer sleeve, the inner sleeve, and at least one divider of the plurality of dividers is in fluid communication with the barrel.

19. The firearm of claim 14, wherein the plurality of barrel openings and the plurality of inner sleeve openings are aligned.

20. The fire arm of claim 16, wherein the plurality of annular dividers are placed into corresponding divider apertures on the inner sleeve.

* * * * *